US005098821A

United States Patent [19]

Cavallo et al.

[11] Patent Number: 5,098,821

[45] Date of Patent: Mar. 24, 1992

[54] LIGHT-SENSITIVE SILVER HALIDE PHOTO-GRAPHIC MATERIALS

[75] Inventors: Elio Cavallo, Savona, Italy; Richard Guenthner, Birchwood, Minn.; Renzo Torterolo, Savona, Italy

[73] Assignee: Minnesota Mining and Manufacturing Company, St. Paul, Minn.

[21] Appl. No.: 219,733

[22] Filed: Jul. 15, 1988

[30] Foreign Application Priority Data

Jul. 24, 1987 [IT] Italy ..... 21425 A/87

[51] Int. Cl.[5] ..... G03C 1/82

[52] U.S. Cl. ..... 430/520; 430/527; 430/539; 430/631; 430/637

[58] Field of Search ..... 430/527, 539, 631, 637, 430/526

[56] References Cited

U.S. PATENT DOCUMENTS 3,884,699 5/1975 Cavallo et al. ..... 96/87 A
4,013,696 3/1977 Babbitt et al. ..... 428/412
4,367,283 1/1983 Nakayama et al. ..... 430/528
4,596,766 6/1986 Nemori et al. ..... 430/527
4,840,881 6/1989 Watanabe et al. ..... 430/527

FOREIGN PATENT DOCUMENTS 1496534 12/1977 United Kingdom .

*Primary Examiner*—Jack P. Brammer
*Attorney, Agent, or Firm*—Gary L. Griswold; Walter N. Kirn; Mark A. Litman

[57] ABSTRACT

Light-sensitive silver halide photographic materials comprising a support base and one or more hydrophilic colloid layers, at least one of which is a silver halide emulsion layer, at least one of said hydrophilic colloid layers of said photographic materials containing both a) a non-ionic surface active agent having a polyoxyethylene group and b) a fluorinated organic compound, characterized by the fact that said fluorinated organic compound is the reaction product of a polyoxyalkyleneamine compound and a fluorinated organic acid compound.

20 Claims, No Drawings

LIGHT-SENSITIVE SILVER HALIDE PHOTO-GRAPHIC MATERIALS

FIELD OF THE INVENTION

The present invention relates to light-sensitive silver halide photographic materials and, more in particular, to light-sensitive silver halide photographic materials having excellent antistatic properties obtained by incorporation of a non-ionic surface active agent and a fluorinated organic salt compound in at least one hydrophilic colloid layer of said photographic materials.

BACKGROUND OF THE INVENTION

Light-sensitive photographic materials generally comprise a support and coated on one or both sides hydrophilic colloid layers including a light-sensitive silver halide emulsion layer (or layers) and, if desired or necessary, other non light-sensitive layers such as subbing layers, intermediate layers, protective layers, backing layers, antihalation layers and the like. Examples of supports include films of a polyalpha-olefin (such as polyethylene, polystyrene, etc.), a polyester (such as polyethyleneterephthalate, etc.), a cellulose ester (such as cellulose triacetate, etc.), paper, synthetic paper or resin-coated paper and the like.

Since the support of a light-sensitive photographic material has electrical insulating properties, static charges are frequently generated during production and use of said photographic material due to contact friction and separation between surfaces of the same kind of materials or surfaces of different kinds of materials. The accumulated static charges may cause various problems. For example, the accumulated static charges may discharge before development of the photographic material and generate light to which the silver halides are sensitive; after development of the photographic material, dot-like marks (called positive static marks) and branch-like marks (called negative static marks) are formed. Said static marks negatively affect the photographic images, particularly X-ray materials for medical and industrial use where static marks may lead to a dangerous misreading. Additionally, the accumulated static charges may attract dust or other particles on the surface of the support negatively affecting the quality during the coating step.

Static charges are, in general, related to the surface resistivity and charge level. Therefore, the accumulation of static charges can be prevented by reducing the surface resistivity or by lowering the charge level.

The surface resistivity of a layer is reduced by addition to the layer of substances which increase the electrical conductivity and release the accumulated electrical charges in a very short time before discharge. In the art, various processes have been disclosed for improving the electrical conductivity of supports and surface layers of photographic materials, and many hygroscopic substances, water soluble inorganic salts, surface active agents, polymers and the like have been suggested to such purpose. For example, polymers as described in U.S. Pat. Nos. 2,822,157, 2,861,056, 2,972,535, 3,062,785, 3,169,949, 3,260,706, 3,262,807, 3,514,291, 3,589,908, 3,607,286, 3,615,531, etc., surface active agents as described in GB patents 861,134, 1,285,647, 1,259,398, 1,330,356, etc., in U.S. Pat. Nos. 2,982,651, 3,428,456, 3,457,076, 3,454,652, 3,552,972, 3,589,906, 3,640,748, 3,655,387, etc., nitrates, metal oxides, semiconductors, colloidal silica or colloidal alumina, etc., as described in GB patent 2,075,208, in U.S. Pat. Nos. 3,062,700, 3,254,833, 3,525,621, 4,264,707, etc., have been proposed for this purpose. Among said substances, non-ionic surfactants having polyoxyethylene chains have been described as having excellent antistatic properties.

Another method to prevent accumulation of static charges is that of lowering the charge level by controlling the triboelectric charge generated on the surface of photographic materials to reduce generation caused by friction and separation of surfaces, as described for example in U.S. Pat. No. 3,888,678. According to this method, fluorine containing compounds, surface active agents, polymers, etc. have been disclosed as substances to reduce static charges. Particularly, fluorine containing surface active agents have been described, for the above purposes, for example in the above mentioned US patent, in GB patents 1,330,356 and 1,524,631, in GB patent application 2,096,782, in U.S. Pat. Nos. 3,666,478, 3,589,906, 3,884,699 and 4,330,618, in JA patent 26687/77 and in JA patent applications 46733/74 and 32322/76.

However, for preventing the accumulation of electric charges, it is difficult to select a single antistatic agent owing to the different kinds of supports, coating compositions and surfaces of materials which are to be considered. Therefore, methods have been described for improving the characteristics of static chargeability of photographic materials, such as those described for example in U.S. Pat. No. 3,884,699 (use of a fluorinated cationic or anionic surfactant in combination with a non-fluorinated betaine surfactant and/or a N-oxide surfactant), GB patent 1,496,534 (use of organic fluorinated compounds in combination with carboxy group-containing organic compounds), U.S. Pat. No. 4,013,696 (use of cationic fluorinated alkyl surfactants in combination with non-ionic alkylphenoxypolypropyleneoxide surfactants), U.S. Pat. No. 4,367,283 (use of non-ionic surfactants having a polyoxyethylene group in combination with anionic surfactants and fluorinated anionic surfactants) and U.S. Pat. No. 4,596,766 (use of a non-ionic surfactant having a polyoxyethylene group in combination with a fluorinated organic compound in a surface layer having a specific amount of said fluorinated compound).

In spite of the numerous methods and compounds described for increasing electrical conductivity and lowering charge level, the production of photographic materials exhibiting a reduced static chargeability is very difficult. Problems are encountered with insufficient reduction in surface resistivity at low humidities, with the contact between the surfaces of the photographic material itself or between such material and other material surfaces at high temperatures and humidities. Such problems become more severe as the sensitivity of the photographic material is higher and the processing speed is increased (such as when the photographic material is used in rapid processing machines where the film is conveyed at a high speed by means of rollers or other surfaces which exert thereon a strong pressure and friction action). On the other hand, compounds which have good antistatic properties, cannot often be used because they negatively affect the photographic properties (such as sensitivity, fog, contrast), image quality (such as graininess, sharpness), the performance of processing chemistries where said antistatic compounds may accumulate, the coating quality, etc., or lose their antistatic ability over a period of time during storage of the photographic material.

Accordingly, the application of antistatic compounds to light-sensitive photographic materials is very difficult and there is a continuous need for providing improved antistatic compositions which do not adversely affect the other characteristics of the material.

SUMMARY OF THE INVENTION

According to the present invention, we have found that the use of both a) a non-ionic surface active compound having a polyoxyalkylene group and b) a fluorinated organic salt compound obtained by reaction of a polyoxyalkyleneamine compound with a fluorinated organic acid compound, allows the static chargeability of photographic layers to be reduced without negatively affecting the photographic characteristics of the light-sensitive materials.

DETAILED DESCRIPTION OF THE INVENTION

The present invention relates to a light-sensitive photographic material comprising a support and at least one or more hydrophilic colloid layers, at least one of which is a silver halide emulsion layer, at least one of said hydrophilic colloid layers containing both a) a non-ionic surface active agent having a polyoxyalkylene group and b) a fluorinated organic compound wherein said fluorinated organic compound is the reaction product of a polyoxyalkyleneamine compound and a fluorinated organic acid compound.

In the present invention, polyoxyalkyleneamine compounds, used to obtain the fluorinated organic compounds, contain amino groups, preferably primary amino groups, attached to the end of a polyoxyalkylene chain. The polyoxyalkylene chain is based either on propylene oxide, ethylene oxide or mixed ethylene/propylene oxide. The polyoxyalkyleneamine compounds comprise monoamine, diamine and traimine compounds with molecular weights ranging from about 200 to about 6,000. Particularly representative polyoxyalkyleneamine compounds are those represented by the following general formulas from (I) to (V):

$$R-(CH_2\underset{\underset{R_1}{|}}{C}HO)_n-CH_2\underset{\underset{CH_3}{|}}{C}HNH_2 \quad (I)$$

$$H_2N\underset{\underset{CH_3}{|}}{C}HCH_2-(OCH_2\underset{\underset{CH_3}{|}}{C}H)_n-NH_2 \quad (II)$$

$$H_2N\underset{\underset{CH_3}{|}}{C}HCH_2-(O\underset{\underset{CH_3}{|}}{C}HCH_2)_a-(OCH_2CH_2)_b-(OCH_2\underset{\underset{CH_3}{|}}{C}H)_c-NH_2 \quad (III)$$

$$H_2N\underset{\underset{CH_3}{|}}{C}HCH_2-(OCH_2\underset{\underset{CH_3}{|}}{C}H)_n-NHCONH-(\underset{\underset{CH_3}{|}}{C}HCH_2O)_n-CH_2\underset{\underset{CH_3}{|}}{C}HNH_2 \quad (IV)$$

$$A\left\langle\begin{array}{l}(OCH_2\underset{\underset{CH_3}{|}}{C}H)_x-NH_2\\(OCH_2\underset{\underset{CH_3}{|}}{C}H)_y-NH_2\\(OCH_2\underset{\underset{CH_3}{|}}{C}H)_z-NH_2\end{array}\right. \quad (V)$$

wherein R represents an alkoxy group which may be substituted, preferably a lower alkoxy group having 1 to 5 carbon atoms, such as methoxy, ethoxy, propoxy, 2-methoxy-ethoxy, etc., $R_1$ represents a hydrogen atom or a methyl group, n represents an integer of 1 to 50, b represents an integer of 5 to 150, a and c, the same or different, each represent an integer from 0 to 5, such that a+c represents an integer from 2 to 5, A represents a $CH\equiv$, $CH_3C\equiv$, $CH_3CH_2C\equiv$ or a $$-CH_2-\underset{\underset{|}{}}{C}H-CH_2-$$

group and x, y and z, equal or different, represent integers of 1 to 30.

Examples of polyoxyalkyleneamine compounds useful to obtain fluorinated organic compounds according to this invention are illustrated below.

$$CH_3OCH_2CH_2O-(CH_2\underset{\underset{CH_3}{|}}{C}HO)_9-CH_2\underset{\underset{CH_3}{|}}{C}HNH_2 \quad (A\text{-}1)$$

$$CH_3OCH_2CH_2O-(CH_2\underset{\underset{CH_3}{|}}{C}HO)_3-(CH_2CH_2O)_{18}-CH_2\underset{\underset{CH_3}{|}}{C}HNH_2 \quad (A\text{-}2)$$

$$H_2N\underset{\underset{CH_3}{|}}{C}HCH_2-(OCH_2\underset{\underset{CH_3}{|}}{C}H)_{2-3}-NH_2 \quad (A\text{-}3)$$

$$H_2N\underset{\underset{CH_3}{|}}{C}HCH_2-(OCH_2\underset{\underset{CH_3}{|}}{C}H)_{5-6}-NH_2 \quad (A\text{-}4)$$

$$H_2N\underset{\underset{CH_3}{|}}{C}HCH_2-(O\underset{\underset{CH_3}{|}}{C}HCH_2)_a-(OCH_2CH_2)_b-(OCH_2\underset{\underset{CH_3}{|}}{C}H)_c-NH_2 \quad (A\text{-}5)$$

wherein b is ~8.5 and a + c is ~2.5

$$H_2N\underset{\underset{CH_3}{|}}{C}HCH_2-(O\underset{\underset{CH_3}{|}}{C}HCH_2)_a-(OCH_2CH_2)_b-(OCH_2\underset{\underset{CH_3}{|}}{C}H)_c-NH_2 \quad (A\text{-}6)$$

wherein b is ~15.5 and a + c is ~2.5

-continued $$H_2N\underset{\underset{CH_3}{|}}{CH}CH_2-(OCH_2\underset{\underset{CH_3}{|}}{CH})_{5-6}-NHCONH-(\underset{\underset{CH_3}{|}}{CH}CH_2O)_{5-6}-CH_2\underset{\underset{CH_3}{|}}{CH}NH_2 \quad \text{(A-7)}$$

$$H_2N\underset{\underset{CH_3}{|}}{CH}CH_2-(OCH_2\underset{\underset{CH_3}{|}}{CH})_{33}-NHCONH-(\underset{\underset{CH_3}{|}}{CH}CH_2O)_{33}-CH_2\underset{\underset{CH_3}{|}}{CH}NH_2 \quad \text{(A-8)}$$

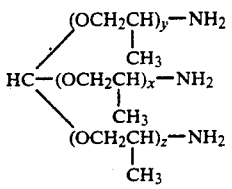

(A-9)

wherein x + y + z ~ 5.6

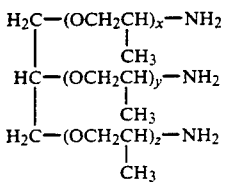

(A-10)

wherein x + y + z ~ 30

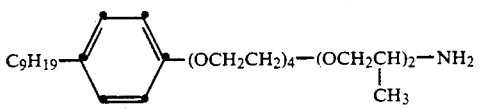

(A-11)

Polyoxyalkyleneamine compounds are commercially available with the name of Jeffamine TM Polyoxyalkyleneamines manufactured by Texaco Chemical Company.

Preferably, fluorinated organic acid compounds, suitable to react with polyoxyalkyleneamine compounds, are perfluoroalkylsulfonic acid compounds. Suitable perfluoroalkylsulfonic acid compounds are represented by the following general formula:

$$\{R_f-(B)_o\}-(SO_3H)_p \quad \text{(VI)}$$

wherein $R_f$ represents an unsubstituted or substituted alkyl group having 2 to 18 carbon atoms, preferably 5 to 10 carbon atoms, or an unsubstituted or substituted alkenyl group having 2 to 15 carbon atoms, preferably 4 to 8 carbon atoms in which the hydrogen atoms are partially or completely substituted with fluorine atoms to include at least 3 fluorine atoms, B represents a divalent organic group, o represents 0 to 1 and p represents 1 or 2. B preferably represents a carbonyl, a sulfonyl, an amino, an alkylene group preferably having 1 to 3 carbon atoms, an arylene group (such as phenylene or naphthylene), an oxygen atom or groups consisting of two or more of the above-mentioned groups, such as for instance carbonylamino, sulfonylamino, aminocarbonyl, aminosulfonyl, ester or polyoxyalkylene groups preferably containing 2 to 40 oxyalkylene unities.

Examples of perfluoroalkylsulfonic acids are illustrated below.

$$C_8F_{17}-SO_3H \quad \text{(B-1)}$$

-continued $$C_8F_{17}-\underset{\underset{C_3H_7}{|}}{N}-CH_2SO_3H \quad \text{(B-2)}$$

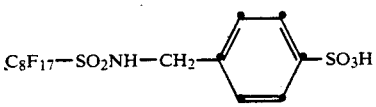

(B-3)

$$H-(CF_2)_6-COOCH_2CH_2CH_2-SO_3H \quad \text{(B-4)}$$

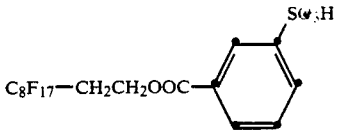

(B-5)

$$C_7F_{15}-\underset{\underset{CH_3}{|}}{CON}-CH_2CH_2SO_3H \quad \text{(B-6)}$$

$$\begin{array}{l} H-(CF_2)_6-CH_2OOC-CH_2 \\ \qquad\qquad\qquad\qquad\quad | \\ H-(CF_2)_6-CH_2OOC-CH-SO_3H \end{array} \quad \text{(B-7)}$$

$$\begin{array}{l} H-(CF_2)_8-CH_2O-(CH_2CH_2O)_3-OC-CH_2 \\ \qquad\qquad\qquad\qquad\qquad\qquad\qquad\qquad\quad | \\ H-(CF_2)_8-CH_2O-(CH_2CH_2O)_3-OC-CH-SO_3H \end{array} \quad \text{(B-8)}$$

$$C_8F_{17}SO_2\underset{\underset{C_3H_7}{|}}{N}-(CH_2CH_2O)_4-(CH_2)_4-SO_3H \quad \text{(B-9)}$$

$$C_{16}H_{33}-\underset{\underset{SO_3H}{|}}{CH}-CONH-(CF_2)_3-H \quad \text{(B-10)}$$

-continued $$C_8F_{17}SO_2N(C_3H_7)-CH_2CH_2OSO_3H$$

(B-11)

$$C_6H_{13}O-OC-CH_2$$
$$C_8F_{17}CH_2CH_2O-OC-CH(-)-SO_3H$$

(B-12)

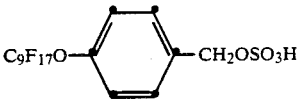

(B-13)

$$HO_3S-(CF_2)_4-SO_3H$$

(B-14)

$$C_4F_9-SO_3H$$

(B-15)

-continued $$C_7F_{15}-SO_3H$$

(B-16)

The above listed perfluoroalkylsulfonic acid compounds can be found on the market or prepared in a conventional way.

The fluorinated organic salt compounds according to the present invention can be prepared by direct reaction of the above described polyoxyalkyleneamine compounds with the above described fluorinated organic acid compounds, preferably in the presence of a low-boiling organic solvent, e.g. methanol, ethanol, acetone, and the like, and separating the fluorinated organic salt compound with techniques known in the art.

Examples of fluorinated organic salt compounds suitable to the purpose of the present invention are illustrated below.

$$H_3C-CH(CH_3)-NH_2.C_8F_{17}SO_3H \quad (1)$$
$$CH_2-(OCH(CH_3)CH_2)_a-(OCH_2CH_2)_b-(OCH_2CH(CH_3))_cNH_2.C_8F_{17}SO_3H$$

(wherein b = 8.5 and a + c = 2.5)

$$H_3C-CH(CH_3)-NH_2.C_4F_9SO_3H \qquad HO_3SF_9C_4.H_2N-CH(CH_3)-CH_3 \quad (2)$$
$$CH_2-(OCH(CH_3)CH_2)_a-(OCH_2CH_2)_b-(OCH_2CH(CH_3))_c-CH_2$$

(wherein b = 15.5 and a + c = 2.5)

$$H_3C-CH(CH_3)-NH_2.C_7F_{15}SO_3H \qquad HO_3SF_{15}C_7.H_2N-CH(CH_3)-CH_3 \quad (3)$$
$$CH_2-(OCH(CH_3)CH_2)_a-(OCH_2CH_2)_b-(OCH_2CH(CH_3))_c-CH_2$$

(wherein b = 40.5 and a + c = 2.5)

$$CH_3OCH_2CH_2O-(CH_2CH(CH_3)O)_9-CH_2CH(CH_3)NH_2.C_8F_{17}SO_3H \quad (4)$$

$$CH_3OCH_2CH_2O-(CH_2CH(CH_3)O)_9-CH_2CH(CH_3)NH_2.C_8F_{17}-N(C_3H_7)-CH_2SO_3H \quad (5)$$

$$CH_3OCH_2CH_2O-(CH_2CH(CH_3)O)_9-CH_2CH(CH_3)NH_2.HO_3S \quad (6)$$
$$(CF_2)_4$$
$$CH_3OCH_2CH_2O-(CH_2CH(CH_3)O)_9-CH_2CH(CH_3)NH_2.HO_3S$$

$$(OCH_2CH(CH_3))_x-NH_2.C_8F_{17}SO_2N(C_3H_7)-CH_2CH_2OSO_3H \quad (7)$$
$$HC-(OCH_2CH(CH_3))_x-NH_2.C_8F_{17}SO_2N(C_3H_7)-CH_2CH_2OSO_3H$$
$$(OCH_2CH(CH_3))_x-NH_2.C_8F_{17}SO_2N(C_3H_7)-CH_2CH_2OSO_3H$$

(wherein x + y + z = ~ 5-6)

-continued (8)

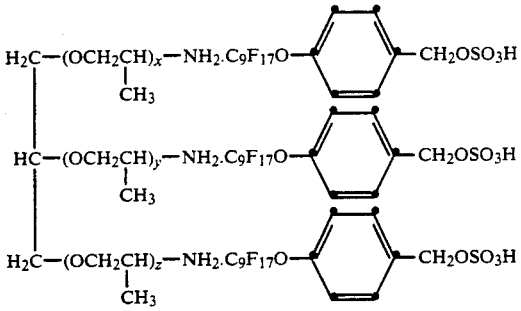

(wherein x + y + z = ~ 30).

Non-ionic surface active agents, for use in the present invention in combination with fluorinated organic salt compounds, are described, for example in British Patent 861,134, in U.S. Pat. Nos. 2,982,651, 3,428,456, 3,457,076, 3,454,625, 3,552,927, 3,655,387, 3,850,641, 4,367,283, 4,518,354, 4,596,766 and in Japanese Patent Publication 208,743/83.

In the present invention, non-ionic surface active agents having a polyoxyalkylene chain represented by the following general formula (VII) are particularly effective as non-ionic surface active agents:

$$R_2-(D)_q-(\underset{\underset{R_3}{|}}{CH}CH_2O)_rH \qquad \text{(VII)}$$

wherein $R_2$ represents an unsubstituted or substituted alkyl group having 1 to 30 carbon atoms, an unsubstituted or substituted alkenyl group having 1 to 30 carbon atoms or an unsubstituted or substituted aryl group (such as phenyl or naphthyl), $R_3$ represents a hydrogen atom or a methyl group, D represents a group —O—, —S—, —COO—, $$-\underset{\underset{R_4}{|}}{N}-,\ -CO-\underset{\underset{R_4}{|}}{N}-,\ \text{or}\ -SO_2-\underset{\underset{R_4}{|}}{N}-$$

wherein $R_4$ represents a hydrogen atom or an unsubstituted or substituted alkyl group having 1 to 12 carbon atoms, q represents 0 to 1 and r represents an integer of 2 to 50.

Examples of non-ionic polyoxyalkylene surface active agents which are preferably used in combination with fluorinated organic salt compounds according to this invention are illustrated below.

$$C_{12}H_{25}O-(CH_2CH_2O)_{10}-H \qquad (9)$$

$$C_8H_{17}O-(CH_2CH_2O)_7-H \qquad (10)$$

$$C_{11}H_{23}COO-(CH_2CH_2O)_8-H \qquad (11)$$

$$C_{15}H_{31}COO-(CH_2CH_2O)_{15}-H \qquad (12)$$

(13)

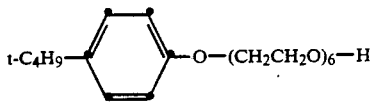

-continued (14)

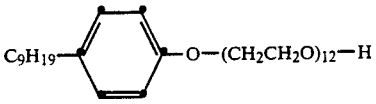

(15)

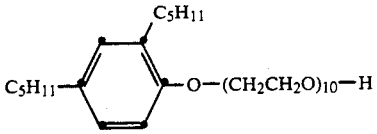

$$C_8H_{17}SO_2-\underset{\underset{C_3H_7}{|}}{N}-(CH_2CH_2O)_{20}-H \qquad (16)$$

$$C_{13}H_{27}CO-\underset{\underset{CH_3}{|}}{N}-(CH_2CH_2O)_{10}-H \qquad (17)$$

(18)

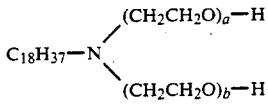

a + b = 20

$$C_{12}H_{25}O-(\underset{\underset{CH_3}{|}}{CH}CH_2O)_3-(CH_2CH_2O)_{15}-H \qquad (19)$$

(20)

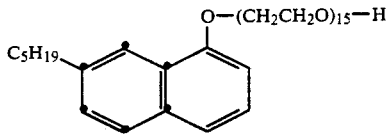

In particular, the improved light-sensitive photographic materials of the present invention comprise:

a) a support base, b) at least one hydrophilic colloidal silver halide emulsion layer, c) at least one hydrophilic colloidal protective layer for said emulsion layer, and (optionally)

d) at least one hydrophilic colloidal backing layer, the improvement consisting in that at least one hydrophilic colloidal layer, preferably the protective and/or the backing layer, more preferably both the protective and the silver halide emulsion layers, comprise the non-ionic surface active agent and the fluorinated organic salt compound, as defined above.

More in particular, the improved light-sensitive photographic material is a radiographic material comprising:

a) a support base, b) at least one hydrophilic colloidal silver halide emulsion layer coated on each side of said support base, and c) a hydrophilic colloidal protective layer coated on each emulsion layer, the improvement consisting in that at least one hydrophilic colloidal protective layer, preferably at least one hydrophilic colloidal protective layer and at least one hydrophilic colloidal silver halide emulsion layer, contain the non-ionic surface active agent and the fluorinated organic salt compound, as defined above.

The non-ionic surface active agents and the fluorinated organic salt compounds are used in amounts sufficient to provide an antistatic effect. A preferred amount of non-ionic surface active agents ranges from about 10 to about 1000 mg/m$^2$, a more preferred amount ranges from about 50 to about 200 mg/m$^2$. A preferred amount of fluorinated organic salt compounds ranges from about 0.5 to about 1000 mg/m$^2$, a more preferred amount ranges from about 2.5 to about 500 mg/m$^2$. Of course, said ranges will vary depending upon the support base, the photographic composition, the manufacturing process and the use of the photographic material. The non-ionic surface active agents and the fluorinated organic salt compounds above can be introduced into the hydrophilic colloid composition forming upon coating the photographic layers in the form of solutions, as known to those skilled in the art. The solvents preferably used are water, alcohol and acetone or mixture thereof or any other solvent, provided that it causes no damage to the photographic emulsion. Alternatively, the non-ionic surface active agents and the fluorinated organic salt compounds above can be introduced in a separate outermost layer not having any binder present therein, as described for example in GB 1,334,429, coated onto the protective and/or the backing layer of the photographic element.

The photographic layers of the present invention comprise or essentially consist of hydrophilic colloidal binder. Such hydrophilic colloidal binder preferably is gelatin or any other film-forming binder permeable to the conventional processing baths for photographic materials alone or mixed with gelatin.

Such hydrophilic binder can contain dispersed hydrophobic polymer particles to improve the physical characteristics of the layers. Particles of this type consist of instance of polyethylacrylate obtained for instance in the form of a latex.

Such layers can be hardened with hardeners known to those skilled in the art, such as for example formaldehyde, glyoxal, succinaldehyde, glutaraldehyde, resorcynaldehyde, mucochloric acid, epoxides, divinylsulfones used alone or in association and can contain any other coating materials known to those skilled in the art.

In the case of photographic emulsions, the layers will contain dispersed silver halides, such as for instance bromide, iodide and chloride or mixtures thereof and antifog compounds and stabilizers in association therewith. The silver halides can be chemically and spectrally sensitized, as known in the art. In the case of color emulsions, such layers can also contain couplers which upon color development with p-phenylenediamines give rise to yellow, magenta and cyan dyes, as described for instance in C. E. Kenneth Mees and T. H. James, "The Theory of the Photographic Process", 3rd edition. Said emulsion layers can contain anionic non-fluorinated surface active agents, preferably in a quantity ranging from 10 to 1000 mg/m$^2$, more preferably from 50 to 200 mg/m$^2$.

The present invention is now illustrated in more detail making reference to the following example.

EXAMPLE

A control photographic material (film A) was prepared by blending three different silver iodobromide emulsions in order to obtain the desired sensitometric curve. Three emulsions respectively having silver iodide mole percent contents of 1.9 (first emulsion), 2.2 (second emulsion) and 1.5 (third emulsion) and average grain sizes of 1.35 (first emulsion), 0.65 (second emulsion) and 0.4 (third emulsion) μm were blended to have 19% by weight of the total silver content derived from the first emulsion, 48% from the second emulsion and 33% from the third emulsion. This emulsion blend was added with the coating finals, a green spectral sensitizing dye and 2.5 g per mole of silver of Hostapur TM SAS 93 (an anionic surfactant of the alkane sulfonate sodium salt type, manufactured by Hoechst AG). The emulsion blend was coated on both sides of a polyethyleneterephthalate transparent base at a total silver coating weight of 5.1 g/m$^2$. On each emulsion layer was applied a gelatin protective coating having a dry thickness of 0.9 μm. This protective coating was prepared from a solution of gelatin which had been added with polymethylmethacrylate (PMMA) as matting agent, 4 (an anionic surfactant corresponding to the formula:

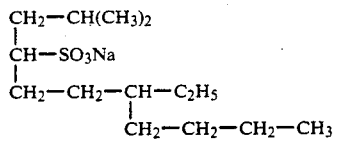

manufactured by Union Carbide Co.) and a hardening agent.

Another control material (Film B) was prepared in the same way comprising the same emulsion blend layers and the gelatin protective coatings prepared from a of gelatin added with PMMA, Tegobetaine TM L7 (a betainic surfactant corresponding to the formula:

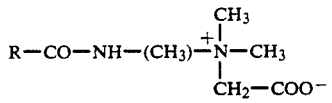

wherein R is an alkyl chain of 12 to 17 carbon atoms, manufactured by Th. Goldschmidt AG), compound A (a cationic fluorinated compound corresponding to the formula:

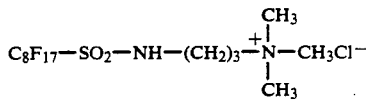

manufactured by 3M Company) and a hardening agent.

A photographic material according to this invention (Film C) was prepared in the same way but a) each emulsion layer, instead of Hostapur TM SAS, contained 0.8 g per mole of silver of Tergitol TM NPX (a non-ionic surfactant of the nonylphenyl-polyethyleneglycol-ether type manufactured by Union Carbide Co.) and 0.08 g per mole of silver of compound 1 (a fluorinated salt compound corresponding to the formula:

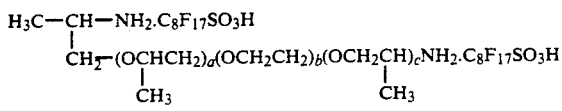

wherein b=8.5 and a+c=2.5) and b) each protective coating comprised PMMA, Tergitol TM NPX and compound 1.

The composition of each protective layer is reported in the following table 1. The numbers indicate grams per gram of gelatin.

TABLE 1

| | Film A | Film B | Film C |
|---|---|---|---|
| Gelatin | 1.0 | 1.0 | 1.0 |
| PMMA | 0.055 | 0.055 | 0.067 |
| Tergitol TM 4 | 0.03 | 0.03 | — |
| Tergitol TM NPX | — | — | 0.027 |
| Tegobetaine TM L7 | — | 0.038 | — |
| Compound A | — | 0.0033 | — |
| Compound 1 | — | — | 0.0048 |

Sample of the three films were treated for 15 hours at 50° C.

After having conditioned the samples at 21° C. and 25% RH for 15 hours, the charging amount and the occurrence of static marks generated on these samples of photographic films were measured in the following manner.

(a) Measurements of generated static marks

Samples having the dimensions of 3.5×29 cm and 7.9×24 cm were cut from the films above and conditioned at 25% RH and 21° C. for 15 hours under suitable safelight conditions. The samples were then evaluated for electrical properties by passing them between rollers made of different materials. In a slow test, the samples measuring 7.9×24 cm were passed between opposed steel and rubber rollers. The fixed steel roller had a diameter of 13 cm and was driven at a variable speed by an electric motor. The opposed rubber roller had a diameter of 2.4 cm and was held in position, against the steel roller, by a 3 Kg counterweight. The steel roller was driven at such a speed that the film velocity was 10 m/min. In a fast test, the steel roller was substituted by a fixed rubber covered steel roller having a diameter of 13 cm. The opposed steel roller had a diameter of 2.4 cm and was held in position by a 3 Kg counterweight. The film velocity was 300 m/min. Each sample of film was passed three times between the rollers and processed in a standard 90" process for X-ray films. The amount of static marking was evaluated using a scholastic rating scale wherein 8 is good (no static marks generated), 1 is bad (static marks on the entire surface) and intermediate values represent intermediate situations.

(b) Measurement of charging amount

In order to measure charging amount generated when the film comes in contact with different materials, each sample 3.5 cm wide was fixed on the surface of a polyetetrafluoroethylene resin having a diameter of 13 cm. Rollers of different materials (rubber, steel and a roller covered with a standard X-ray intensifying screen) measuring 2.4 cm in diameter were brought into contact with the sample by means of a 1 Kg counterweight. The velocity of the film was 10 m/min. The charge generated was measured with an electrometer placed 1 cm from the surface of the film as the peak value measured during the time interval of 30" starting from zero velocity.

The results relating to the samples corresponding to the films are reported in the following Table 2.

TABLE 2

| | Static Marks | | Charging Amount | | |
|---|---|---|---|---|---|
| | Slow Test | Fast Test | (a) | (b) | (c) |
| Film A | 3(+) | 3(+) | +5.0 | +6.0 | +5.6 |
| Film B | 2(+−) | 8 | −5.5 | −1.5 | −2.2 |
| Film C | 6.5(+) | 6(+) | +3.5 | +2.5 | +0.7 |

+ = positive static marks
− = negative static marks
a = rubber roller
b = steel roller
c = roller covered with screen From the results above, it can be seen that both comparison films charge to higher values and are inferior to the invention film. Furthermore, the negative charge generated on film B is more disturbing giving rise to large branched marks.

We claim:

1. A light-sensitive photographic element comprising a support and one or more hydrophilic colloid layers, at least one of which is a silver halide emulsion layer, at least one hydrophilic colloid layer containing at least two different compounds, which different compounds are a) a non-ionic surface active agent having a polyoxyalkylene group and b) a fluorinated organic salt compound, said fluorinated organic salt compound being the reaction product of a polyoxyalkyleneamine compound and a fluorinated organic acid compound.

2. The light-sensitive photographic material of claim 1, wherein said polyoxyalkyleneamine compound is represented by one of the following general formulas:

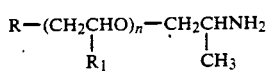

(I)

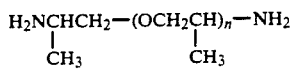

(II)

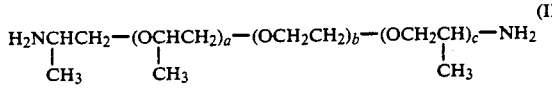

(III)

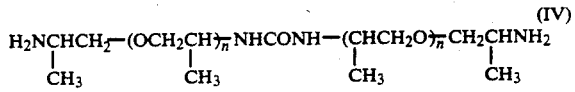

(IV)

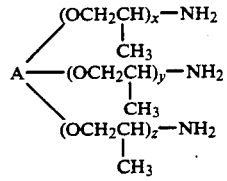

(V)

wherein R represents an alkoxy group which may be substituted, $R_1$ represents a hydrogen atom or a methyl group, n represents an integer of 1 to 50, b represents an integer of 5 to 150, a+c represents an integer of 2 to 5, A represents a CH≡, a $CH_3C$≡, a $CH_3CH_2C$≡ or a $$-CH_2-\underset{|}{CH}-CH_2-$$

group and x, y and z, equal or different, represent integers of 1 to 30.

3. The light-sensitive photographic material of claim 1, wherein said fluorinated organic acid compound is represented by general formula:

$$\{R_f-(B)_o\}-(SO_3H)_p \quad \text{(VI)}$$

wherein $R_f$ represents an unsubstituted or substituted alkyl group having 2 to 18 carbon atoms or an substituted or substituted alkenyl group having 2 to 15 carbon atoms in which the hydrogen atoms are partially or completely substituted with fluorine atoms to include at least 3 fluorine atoms, B represents a divalent organic group, o represents 0 or 1 and p represents 1 or 2.

4. The light-sensitive photographic material of claim 1, wherein said non-ionic surface active agent is represented by general formula:

$$R_2-(D)_q-(\underset{\underset{R_3}{|}}{C}HCH_2O)_rH \quad \text{(VII)}$$

wherein $R_2$ represents an unsubstituted or substituted alkyl group having 1 to 30 carbon atoms, an unsubstituted or substituted alkenyl group having 1 to carbon atoms or an unsubstituted or substituted aryl group, $R_3$ represents a hydrogen atom or a methyl group, D represents an —O—, —S—, —COO—, $$-\underset{\underset{R_4}{|}}{N}-,\ -CO-\underset{\underset{R_4}{|}}{N}-\ \text{or}\ -SO_2-\underset{\underset{R_4}{|}}{N}-$$

group wherein $R_4$ represents a hydrogen atom or an unsubstituted or substituted alkyl group having 1 to 20 carbon atoms, q represents 0 or 1 and r represents an integer of 2 to 50.

5. The light-sensitive photographic material of claim 1, wherein said non-ionic surface active agent is employed in an amount of 10 to 1000 mg/m$^2$ of the photographic material.

6. The light-sensitive photographic material of claim 1, wherein said fluorinated salt compound is employed in an amount of 0.5 to 1000 mg/m$^2$ of the photographic material.

7. The light-sensitive photographic material of claim 1, wherein the hydrophilic colloid of said hydrophilic colloid layer is gelatin.

8. The light-sensitive photographic material of claim 1, wherein said at least one hydrophilic colloid layer is a surface protective layer.

9. The light-sensitive photographic material of claim 1, wherein said at least one hydrophilic colloid layer is a backing layer.

10. The light-sensitive photographic element of claim 1 comprising:

a) a support base, b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 1.

11. The light-sensitive photographic element of claim 2 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 2.

12. The light-sensitive photographic element of claim 3 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 3.

13. The light-sensitive photographic element of claim 4 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 4.

14. The light-sensitive photographic element of claim 5 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 5.

15. The light-sensitive photographic element of claim 6 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 6.

16. The light-sensitive photographic element of claim 7 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 7.

17. The light-sensitive photographic element of claim 8 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 8.

18. The light-sensitive photographic element of claim 9 comprising:

a) a support base b) at least one hydrophilic colloid silver halide emulsion layer coated on each side of said support base, and c) a hydrophilic colloid protective layer coated on each emulsion layer, wherein at least one hydrophilic colloid protective layer comprises the non-ionic surface active agent and the fluorinated organic salt compound as defined in claim 9.

19. The light-sensitive photographic element of claim 3, wherein said non-ionic surface active agent is represented by general formula:

$$R_2-(D)_q-(\underset{\underset{R_3}{|}}{C}HCH_2O)_rH \qquad \text{(VII)}$$

wherein $R_2$ represents an unsubstituted or substituted alkyl group having 1 to 30 carbon atoms, an unsubstituted or substituted alkenyl group having 1 to 30 carbon atoms or an unsubstituted or substituted aryl group, $R_3$ represents a hydrogen atom or a methyl group, D represents an —O—, —S—, —COO—, $$-\underset{\underset{R_4}{|}}{N}-,\ -CO-\underset{\underset{R_4}{|}}{N}-\ \text{or}\ -SO_2-\underset{\underset{R_4}{|}}{N}-$$

group wherein $R_4$ represents a hydrogen atom or an unsubstituted or substituted alkyl group having 1 to 20 carbon atoms, q represents 0 or 1 and r represents an integer of 2 to 50.

20. The light-sensitive photographic element of claim 5, wherein said non-ionic surface active agent is represented by general formula:

$$R_2-(D)_q-(\underset{\underset{R_3}{|}}{C}HCH_2O)_rH \qquad \text{(VII)}$$

wherein $R_2$ represents an unsubstituted or substituted alkyl group having 1 to 30 carbon atoms, an unsubstituted or substituted alkenyl group having 1 to 30 carbon atoms or an unsubstituted or substituted aryl group, $R_3$ represents a hydrogen atom or a methyl group, D represents an —O—, —S—, —COO—, $$-\underset{\underset{R_4}{|}}{N}-,\ -CO-\underset{\underset{R_4}{|}}{N}-\ \text{or}\ -SO_2-\underset{\underset{R_4}{|}}{N}-$$

group wherein $R_4$ represents a hydrogen atom or an unsubstituted or substituted alkyl group having 1 to 20 carbon atoms, q represents 0 or 1 and r represents an integer of 2 to 50.

* * * * *

UNITED STATES PATENT AND TRADEMARK OFFICE

CERTIFICATE OF CORRECTION

PATENT NO. : 5,098,821

DATED : March 24, 1992

INVENTOR(S) : Cavallo et al.

It is certified that error appears in the above-identified patent and that said Letters Patent is hereby corrected as shown below:

| | |
|---|---|
| On the Title page, and in Column 1, line 2: | "photo-graphic" should be --photographic--. |
| Col. 6, line 46: | "$SO_3H$" is not legible. |
| Col. 9, line 51: | "0 to 1" should be --0 or 1--. |
| Col. 11, line 48: | "of instance" should be --for instance--. |
| Col. 12, line 29: | "4" should be --Tergitol™4--. |
| Col. 12, line 43: | "of gelatin" should be --solution of gelatin--. |
| Col. 14, line 35: | "material" should be --element--. |
| Col. 15, line 7: | "material" should be --element--. |
| Col. 15, line 21: | "material" should be --element--. |
| Col. 15, line 32: | "1 to carbon" should be --1 to 30 carbon--. |
| Col. 15, line 46: | "material" should be --element--. |
| Col. 15, line 49: | "material" should be --element-- . |
| Col. 15, line 54: | "material" should be --element--. |
| Col. 15, line 57: | "material" should be --element--. |
| Col. 15, line 60: | "material" should be --element--. |

UNITED STATES PATENT AND TRADEMARK OFFICE

CERTIFICATE OF CORRECTION

PATENT NO. : 5,098,821

DATED : March 24, 1992

INVENTOR(S) : Cavallo et al.

It is certified that error appears in the above-indentified patent and that said Letters Patent is hereby corrected as shown below:

Col. 15, line 60: "material" should be --element--.

Signed and Sealed this

Twenty-first Day of September, 1993

Bruce Lehman

*Attest:*

BRUCE LEHMAN

*Attesting Officer*

*Commissioner of Patents and Trademarks*